US010812893B2

(12) United States Patent
Wexler et al.

(10) Patent No.: US 10,812,893 B2
(45) Date of Patent: Oct. 20, 2020

(54) ARM FOR NAPEBAND-STYLE EARPHONE SYSTEM

(71) Applicant: Bose Corporation, Framingham, MA (US)

(72) Inventors: Ryan Joseph Wexler, Boston, MA (US); Daniel P. Baker, Warwick, RI (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/118,739

(22) Filed: Aug. 31, 2018

(65) Prior Publication Data

US 2020/0077170 A1 Mar. 5, 2020

(51) Int. Cl.
*H04R 1/10* (2006.01)

(52) U.S. Cl.
CPC ..... *H04R 1/105* (2013.01); *H04R 1/1016* (2013.01); *H04R 1/1083* (2013.01); *G10K 2210/1081* (2013.01)

(58) Field of Classification Search
CPC .... H04R 1/105; H04R 1/1016; H04R 1/1083; G10K 2210/1081
See application file for complete search history.

(56) References Cited

U.S. PATENT DOCUMENTS

| | | | | |
|---|---|---|---|---|
| 4,055,233 | A | 10/1977 | Huntress | |
| 5,957,136 | A | 9/1999 | Magidson et al. | |
| 6,129,175 | A | 10/2000 | Tutor et al. | |
| 7,106,877 | B1 * | 9/2006 | Linville | H04R 1/105 381/370 |
| 7,708,110 | B2 * | 5/2010 | Leong | A61F 11/08 128/867 |
| 8,249,287 | B2 | 8/2012 | Silvestri et al. | |
| 8,737,669 | B2 | 5/2014 | Monahan et al. | |
| 2004/0163653 | A1 | 8/2004 | Fleming | |
| 2007/0003093 | A1 | 1/2007 | Ito et al. | |
| 2008/0310666 | A1 * | 12/2008 | Wengreen | H04R 1/026 381/381 |
| 2011/0170702 | A1 | 7/2011 | Bays | |
| 2012/0288133 | A1 * | 11/2012 | Nokuo | H04R 1/105 381/384 |
| 2013/0196721 | A1 | 8/2013 | Waterman et al. | |
| 2017/0023971 | A1 | 1/2017 | Lee et al. | |
| 2017/0230745 | A1 * | 8/2017 | Petersen | H04R 1/1066 |
| 2017/0311069 | A1 | 10/2017 | Prevoir et al. | |

FOREIGN PATENT DOCUMENTS

CN 104254036 A 12/2014

OTHER PUBLICATIONS

PCT International Search Report and Written Opinion for International Application No. PCT/US2019/047485, dated Oct. 30, 2019, 14 pages.

* cited by examiner

*Primary Examiner* — Tuan D Nguyen
(74) *Attorney, Agent, or Firm* — Hoffman Warnick LLC

(57) ABSTRACT

Various implementations include an arm for a napeband-style earphone system and a related earphone system. The arm has sections with distinct stiffness in order to flex over the top of a user's pinna for placement of an earphone proximate the ear.

24 Claims, 10 Drawing Sheets

ARM FOR NAPEBAND-STYLE EARPHONE SYSTEM

TECHNICAL FIELD

This disclosure generally relates to audio devices. More particularly, the disclosure relates to napeband-style earphone devices with an arm for positioning an earphone proximate the ear of a user.

BACKGROUND

Portable electronic devices, including headphone and other wearable audio systems are becoming more commonplace. However, particularly when integrated into an active user's lifestyle, these devices must delicately balance comfort against stability. For some form factors, such as earphone-type headphones, balancing comfort and stability can be particularly challenging.

SUMMARY

All examples and features mentioned below can be combined in any technically possible way.

Various implementations include an arm for a napeband-style earphone system and a related earphone system. The arm has sections with distinct stiffness in order to flex over the top of a user's pinna for placement of an earphone proximate a user's ear, and in some implementations, in the user's ear.

In some particular aspects, an arm for an earphone system includes: a base section for coupling with an electronics compartment, the base section having a first stiffness; a middle section continuous with the base section and having a second stiffness that is less than the first stiffness; and a tip section continuous with the middle section for coupling with an earphone, the tip section having a third stiffness that is less than the second stiffness, where the tip section is configured to flex over the top of the pinna of an ear of a user to position the earphone proximate the ear of the user while the earphone system rests around a head of the user.

In other particular aspects, an earphone system includes: a pair of earphones for positioning in respective ears of a user; an electronics compartment; and an arm connected with at least one of the earphones and the electronics compartment, the arm having: a base section coupled with the electronics compartment, the base section having a first stiffness; a middle section continuous with the base section and having a second stiffness that is less than the first stiffness; and a tip section continuous with the middle section and coupled with at least one of the earphones, the tip section having a third stiffness that is less than the second stiffness, where the tip section is configured to flex over the top of the pinna of one of the ears of the user to position the at least one earphone proximate the ear of the user when the earphone system rests around a head of the user.

Implementations may include one of the following features, or any combination thereof.

In particular cases, the tip section is configured to support a portion of a weight of the earphone system when the earphone system rests around the head of the user.

In some aspects, the base section includes an arced region for wrapping the arm around the head of the user while the tip section wraps over the top of the pinna of the ear.

In certain implementations, the arm demonstrates substantially elastic deformation after removal from over the top of the pinna of the ear of the user.

In particular aspects, the arm further includes a shape-memory material configured to retain a portion of a shape formed by positioning the tip section over the top of the pinna of the ear of the user. In certain cases, the shape-memory material extends only partially along a length of the arm. In some aspects, the shape-memory material has an approximately constant thickness along its length.

In particular implementations, the earphone includes an earbud sized to rest within the ear of the user, and the tip section aids in retaining the earbud within the ear of the user during use of the earphone system.

In certain cases, the arm further includes: wiring for transmitting communication signals between the electronics compartment and the earphone; a stiffness member; a jacket surrounding the stiffness member and the wiring; and a cover surrounding the jacket, the stiffness member and the wiring. In some aspects, the cover and the wiring each extend axially through the base section, the middle section and the tip section, the stiffness member extends axially through the base section, and the jacket extends axially through the base section and the middle section.

In particular cases, the arm further includes a rigid coupling at an end of the base section for connecting the arm with the electronics compartment.

In certain aspects, an outer dimension of the arm tapers from the base section to the tip section.

In some implementations, the base section comprises an elbow that is deformed at rest at an angle of approximately 15-45 degrees.

In particular implementations, the earphone in the earphone system includes an earbud sized to rest within the ear of the user, where the tip section of the arm aids in retaining the earbud within the ear of the user during use of the earphone system, and the arm positions the electronics compartment to rest proximate a nape of the head of the user while the earbud is located within the ear of the user.

In certain cases, the arm is coupled to both of the earphones and the electronics compartment in the earphone system.

In some aspects, the arm includes a single band passing through the electronics compartment to connect the pair of earphones in the earphone system.

In certain cases, the arm is coupled with a first side of the electronics compartment and an additional arm is coupled with a second side of the electronics compartment and the other one of the pair of earphones, where the arm and the additional arm position the electronics compartment to rest proximate a nape of the head of the user while the pair of earphones rest proximate the ears of the user. In particular implementations, the arm and the additional arm provide a clamping force on the head of the user such that the electronics compartment rests proximate the nape of the head of the user while the head rotates.

Two or more features described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

Figure 1A:
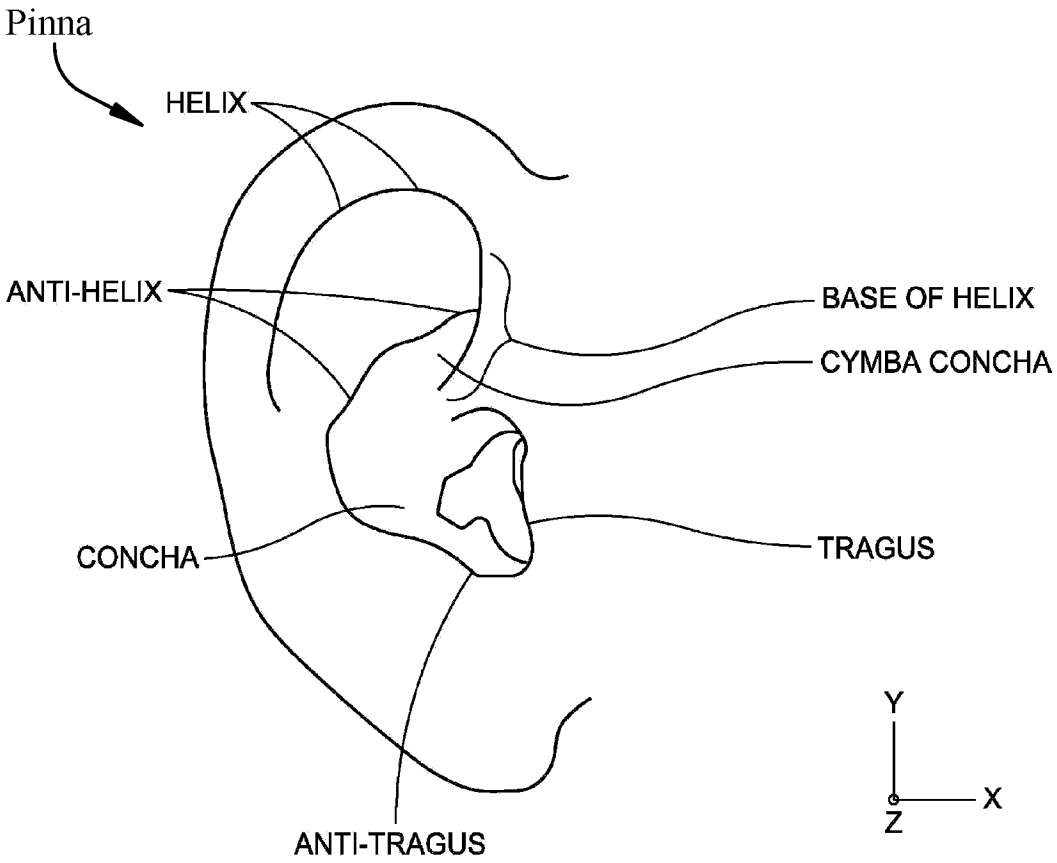
FIG. 1A shows the lateral surface of a human right ear, with some features identified.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that an earphone system can benefit from an arm with sections having distinct stiffness to provide added comfort and stability. For example, the earphone system can include an electronics compartment and a pair of arms for positioning over respective pinna on a user's ears, positioning the earphones proximate to the ear of the user, and in some cases, in the ear of the user, while the earphone system rests around the user's head.

Commonly labeled components in the FIGURES are considered to be substantially equivalent components for the purposes of illustration, and redundant discussion of those components is omitted for clarity.

Figure 1B:
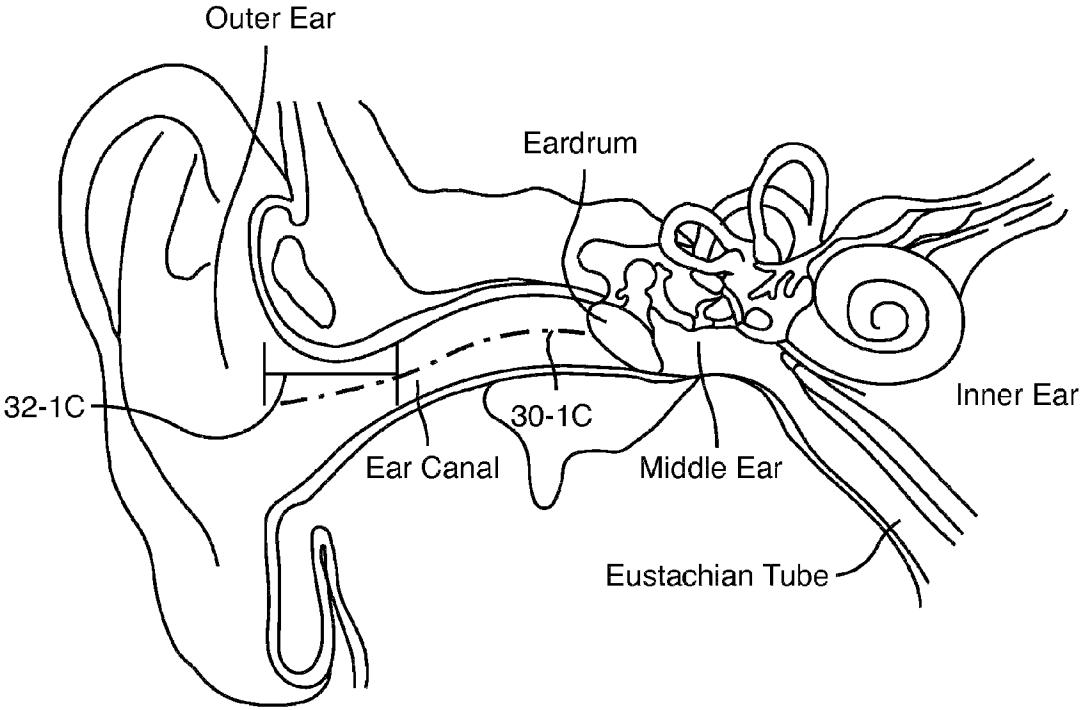
FIG. 1B shows an example cross-section of the human ear, with some features identified.

FIG. 1A shows the lateral surface of a human right ear, with some features identified. There are many different ear sizes and geometries. Some ears have additional features that are not shown in FIG. 1A. Some ears lack some of the features that are shown in FIG. 1A. Some features may be more or less prominent than are shown in FIG. 1A. FIG. 1B shows an example cross-section of the human ear, with some features identified. The ear canal is an irregularly shaped cylinder with a variable cross sectional area and a centerline that is not straight. Among the features identified is the entrance to the ear canal and the main portion of the ear canal. In this specification, the entrance to the ear canal refers to the portion of the ear canal near the concha where the walls of the ear canal are substantially non parallel to the centerline of the ear canal. The precise structure of the human ear varies widely from individual to individual. For example, in the cross-second of FIG. 1B, there is a gradual transition from walls that are non-parallel to a centerline of the ear canal to walls that are substantially parallel to a centerline 30-1C of the ear canal, so the entrance 32-1C to the ear canal is relatively long.

As used herein, the "pinna" of the ear can refer to the outer ear, or the portion of the ear that is external to the body and excludes the ear canal. In various implementations, components will be described relative to the pinna of the ear, e.g., over the top of the pinna. In some cases, these components can fit over a portion of the pinna, e.g., the top, in the space between the back of the outer ear and the head.

For those who employ headphones or headset forms of personal audio devices to listen to electronically provided audio, it is commonplace for that audio to be provided with at least two audio channels (e.g., stereo audio with left and right channels) to be separately acoustically output with separate earpieces to each ear. For those simply seeking to be acoustically isolated from unwanted or possibly harmful sounds, it has become commonplace for acoustic isolation to be achieved through the use of active noise reduction (ANR) techniques based on the acoustic output of anti-noise sounds in addition to passive noise reduction (PNR) techniques based on sound absorbing and/or reflecting materials. Further, it is commonplace to combine ANR with other audio functions in headphones.

Aspects and implementations disclosed herein may be applicable to earphone systems that either do or do not support two-way communications, and either do or do not support active noise reduction (ANR). For earphone systems that do support either two-way communications or ANR, it is intended that what is disclosed and claimed herein is applicable to an earphone system incorporating one or more microphones disposed on a portion of the personal audio device that remains outside an ear when in use (e.g., feedforward microphones), on a portion that is inserted into a portion of an ear when in use (e.g., feedback microphones), or disposed on both of such portions. Still other implementations of earphone systems to which what is disclosed and what is claimed herein is applicable will be apparent to those skilled in the art.

As described herein, an "earphone" in an "earphone system" can include an over-ear, on-ear, in-ear or near-ear earphone, which can include an acoustic driver module (e.g., transducer(s)) as well as related electronics contained in or otherwise coupled via a housing. In various implementations, as described herein, earphones can include one or more microphones, which can be used for noise canceling. While some earphones shown and described according to implementations include in-ear earphones (e.g., those earphones that rest within a user's ear and provide an output to the user's ear canal), various implementations can include earphone systems with over-ear earphones (e.g., earphones that substantially seal against the user's head over the ear), on-ear earphones (e.g., earphones that rest on the user's ear and substantially seal around the helix of the user's ear) or near-ear earphones (e.g., earphones that rest on the user's ear or on the user's head within a few inches of the user's ear). These earphones all rest proximate the user's ear, i.e., contacting the ear or adjacent the user's ear. In some cases, the earphone is considered proximate the user's ear when it is located within 0.5 to 3 inches of the user's ear.

Figure 2:
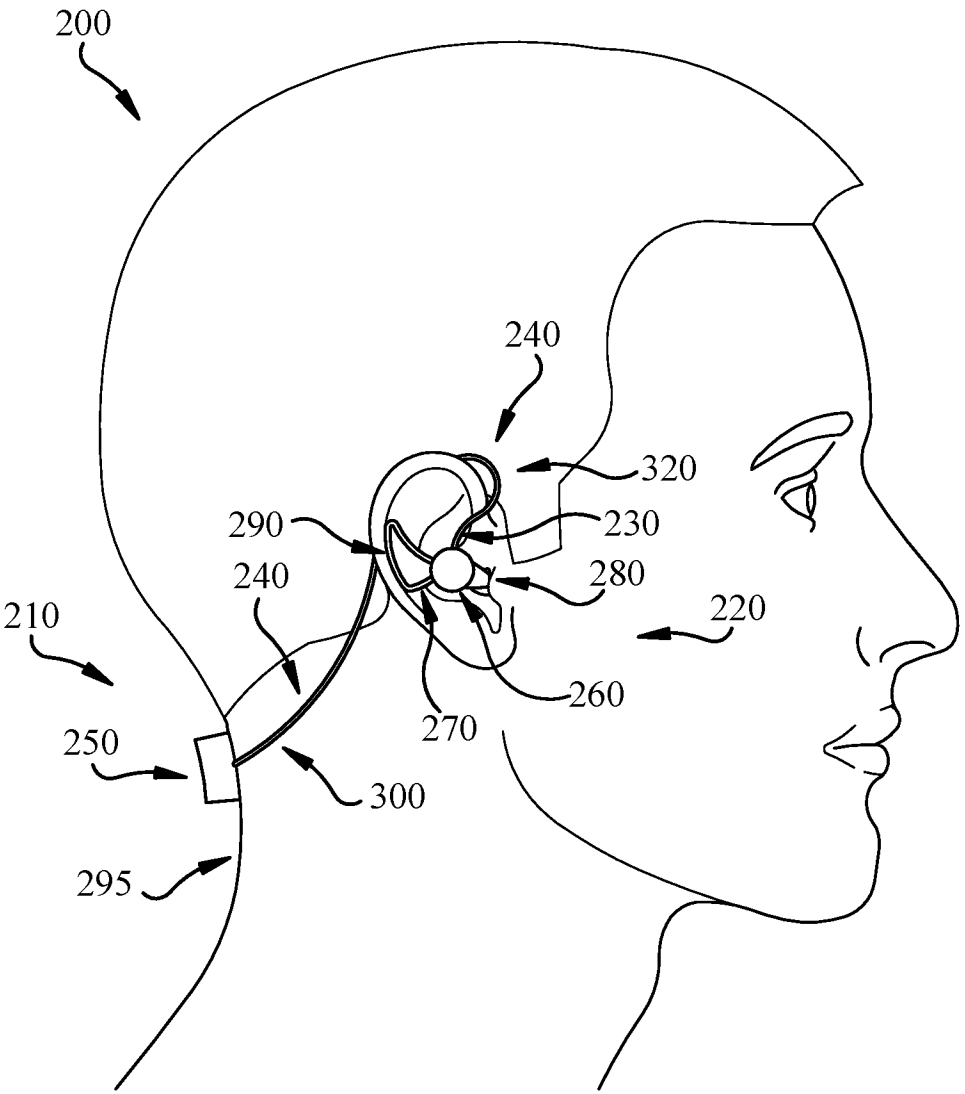
FIG. 2 shows a schematic side view of an earphone system on the head of a user according to various implementations.

FIG. 2 is a right-side schematic view of a user (e.g., a human user) 200 including a depiction of a portion of an earphone system 210 according to various implementations. In various implementations, the earphone system 210 can include a pair of earphones 220 (right earphone shown in this view) for positioning in respective ears of the user 200 (e.g., where a right earphone is oriented to fit a right ear and a left earphone is oriented to fit a left ear).

Each earphone (also referred to as an "earpiece") 220 can include a stem 230 for positioning an arm (or, cable) 240 coupled with an electronics compartment 250, and a body 260 connected with the stem 230. As is known in the art, in some cases, the body 260 can include an acoustic driver module 270 and a tip 280. In some circumstances, the body 260 is also called an "earbud", however, in other circumstances the tip 280 is referred to as an earbud. Different earphone configurations can be utilized with the various implementations disclosed herein, and it is understood that the earphone 220 illustrated in FIG. 2 is merely one example of such a configuration.

Some earphones 220 may also include electronics modules (not shown) for wirelessly communicating with external devices. Other earphones may lack the acoustic driver module and may function as passive earplugs. The tip 280 can include a sealing structure for sealing the entrance to the ear canal. The earphone 220 can additionally include a positioning and retaining structure 290. In operation, the earphone 220 is placed proximate the ear, e.g., in the ear, and is oriented and held in place by the positioning and retaining structure 290, the tip 280 and other portions of the earphone 220.

As described herein, the earphone 220 can additionally include one or more feedback microphone(s) and one or more feedforward microphones for noise reduction (e.g., ANR). In implementations that include ANR, each earphone 220 can include an inner microphone that may be a feedback microphone and an outer microphone that may be a feedforward microphone. In such implementations, each earphone 220 includes an ANR circuit that is in communication with the inner and outer microphones. The ANR circuit receives an inner signal generated by the inner microphone and an outer signal generated by the outer microphone, and performs an ANR process for the corresponding earphone 220. The process includes providing a signal to the driver module (e.g., speaker) 270 to generate an anti-noise acoustic signal that reduces or substantially prevents sound from one or more acoustic noise sources that are external to the earphone 220 from being heard by the user. As described herein, in addition to providing an anti-noise acoustic signal, the driver module 270 can utilize its sound-radiating surface for providing an audio output for playback. Additional aspects of the earphones are described in U.S. patent application Ser. No. 16/118,727 (filed concurrently on Aug. 31, 2018).

The electronics compartment 250 can house components for controlling various functions of the earphone system 210. It is understood that one or more of the components in the electronics compartment 250 may be implemented as hardware and/or software, and that such components may be connected by any conventional means (e.g., hard-wired and/or wireless connection). It is further understood that unless otherwise noted, components described as connected or coupled to another component in the earphone system 210 or other systems disclosed according to implementations may communicate using any conventional hard-wired connection and/or additional communications protocols. In some cases, communications protocol(s) can include a Wi-Fi protocol using a wireless local area network (LAN), a communication protocol such as IEEE 802.11 b/g a cellular network-based protocol (e.g., third, fourth or fifth generation (3G, 4G, 5G cellular networks) or one of a plurality of internet-of-things (IoT) protocols, such as: Bluetooth, BLE Bluetooth, ZigBee (mesh LAN), Z-wave (sub-GHz mesh network), 6LoWPAN (a lightweight IP protocol), LTE protocols, RFID, ultrasonic audio protocols, etc.

In various implementations, the electronics compartment 250 can include a digital signal processor (DSP) and a power source, and in some cases, may include an additional transducer and/or microphones. In certain implementations, the electronics compartment 250 can further include a sensor system such as a location tracking system (e.g., a GPS device) and/or an inertial measurement unit (IMU) for detecting movement of the earphone system 210 and enabling particular control functions. Each of the DSP, transducer, microphone(s), power source and sensor system are connected with a controller, which is configured to perform control functions according to various implementations described herein. Electronics compartment 250 can include other components not specifically described, such as communications components (e.g., a wireless transceiver (WT)) configured to communicate with one or more other electronic devices connected via one or more wireless networks (e.g., a local WiFi network, Bluetooth connection, or radio frequency (RF) connection), and amplification and signal processing components. It is understood that these components or functional equivalents of these components can be connected with, or form part of, the controller.

In some particular implementations, the earphone system 210 can include a conversation enhancing headphone system. That is, the earphone system 210 can be controllable to modify audio playback, for example, by adjusting characteristics of environmental (or "world") sound and tuning particular audio characteristics (e.g., treble and bass) to enhance the user experience. The earphone system 210 can rely upon ANR processes in order to provide this enhanced audio playback to the user.

Sealing the ear canal with the tip 280 can be particularly important when providing conversation enhancing functions such as ANR. That is, if the ear canal is not properly sealed by the tip 280, feedforward microphone(s) can capture audio playback escaping the ear canal and create unwanted feedback or "whistling." This phenomenon is sometimes experienced by users of conventional hearing aids, and significantly diminishes the user experience.

The earphone system 210 depicted in FIG. 2 can provide for enhanced sealing of the ear canal by use of the arm 240. In particular, the arm 240, which is configured to rest over the top of the pinna and connect with the earpiece 220 from above (when worn), can provide stability such that the earpiece 220 remains in place proximate the ear, e.g., in the ear canal, during use. Additionally, the arm 240 is configured to form a napeband-style headband that positions the electronics compartment 250 proximate the nape 295 of the head. In this sense, during use, the arm 240 locates the electronics compartment 250 proximate or below the user's occipital bone, but above the shoulders. This configuration can mitigate unwanted pull, or tension, on the wire when the user moves, e.g., by rotating the head or looking down. Additionally, placement of the arm 240 over the top of the pinna can reduce the tension on the section of the arm 240 overlying the front of the outer ear, maintaining stability in the earpiece seal.

Figure 3:
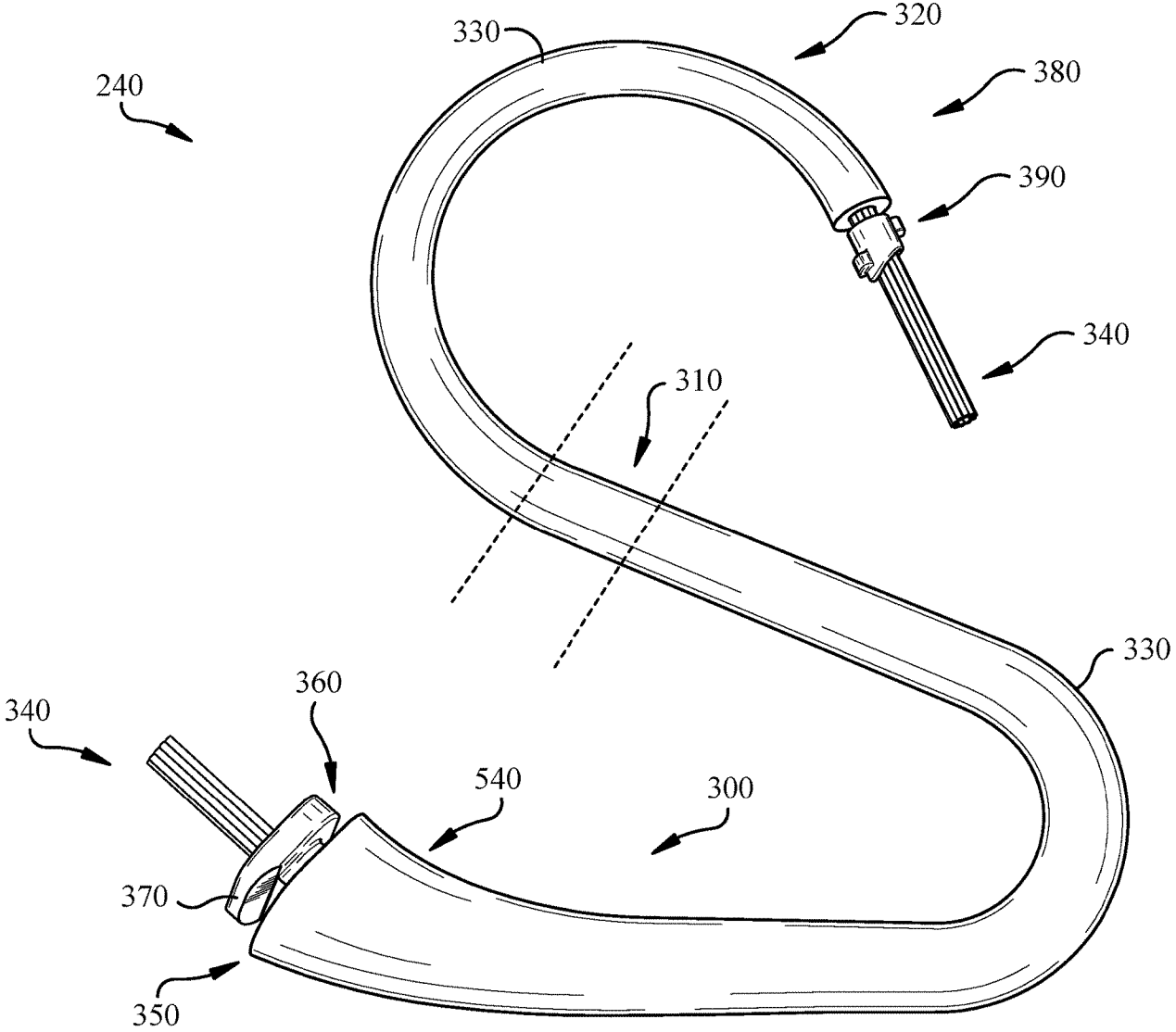
FIG. 3 is a schematic depiction of an arm in the earphone system of FIG. 2.

FIG. 3 shows a schematic depiction of the arm 240 in isolation from the electronics compartment 250 and the earpiece 220 (FIG. 2). FIGS. 2 and 3 are referred to simultaneously. The arm 240 is shown including a base section 300 for coupling with the electronics compartment 250, a middle section 310 that is continuous with the base section 300, and a tip section 320 that is continuous with the middle section 310 and is configured to couple with one of the earphones 220. As described herein, each of the base section 300, middle section 310 and tip section 320 can have a distinct stiffness, enabling stable and comfortable positioning of the earphone system 210 on the user's head. That is, the base section 300 can have a first stiffness, the middle section can have a second stiffness that is less than the first stiffness, and the tip section can have a third stiffness that is less than the second stiffness. Delineations between the sections 300, 310, 320 are illustrated as examples, although it is understood that these section lines may be shifted in particular implementations. In most implementations, the length of the middle section 310 (as measured along the primary axis of the arm 240) is less than the length of each of the base section 300 and the tip section 320.

As shown in FIG. 3, the arm 240 can include a cover 330 that surrounds wiring 340 running between the electronics compartment 250 and the earpiece 220 (FIG. 2). In various implementations, the cover 330 can be formed, e.g., of silicone, thermoplastic elastomer (TPE), thermoplastic polyurethane (TPU), fluoroelastomer (FKM) and/or another material providing comparable stiffness properties, cosmetic properties and chemical resistance (e.g., for cleaning and interaction with human skin). The cover 330 is configured to directly contact human skin, and as such, silicone may be a beneficial material for interaction with different skin types (e.g., oily v. dry skin). The wiring 340 can extend axially through the base section 300, middle section 310 and tip section 320, and can be used for power transmission, communications, signal processing, etc. At the proximal end 350 of the arm 240 is a rigid coupling 360 for connecting the arm 240 with the electronics compartment 250. In some cases, the rigid coupling 360 includes a stopper 370 for contacting the electronics compartment 250. At the distal end 380 of the arm 240 is an earphone stopper 390 for contacting the earphone 220 (e.g., the body 260 or stem 230 of the earphone 220).

Figure 4:
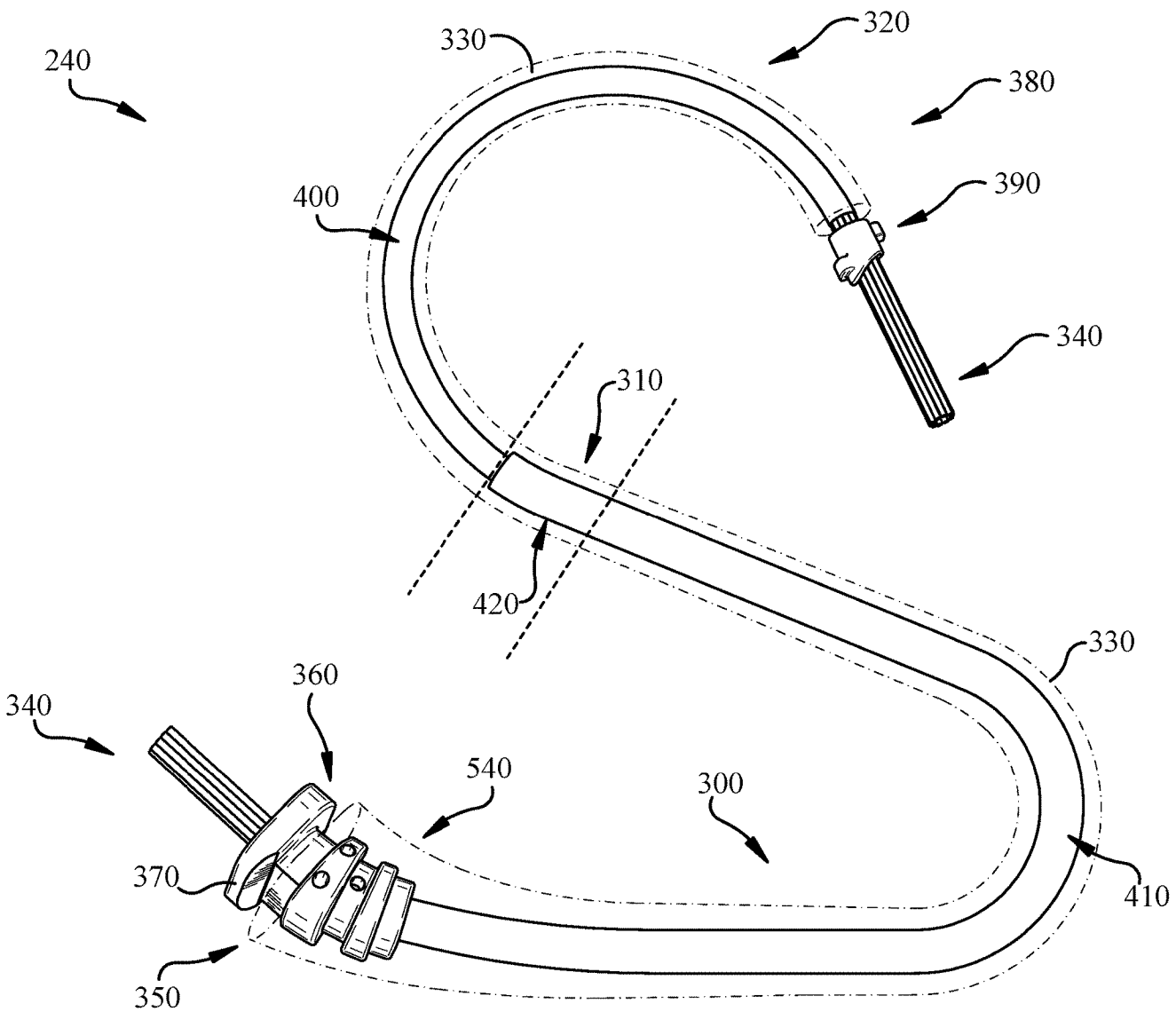
FIG. 4 is a partially transparent depiction of the arm of FIG. 3.
Figure 5:
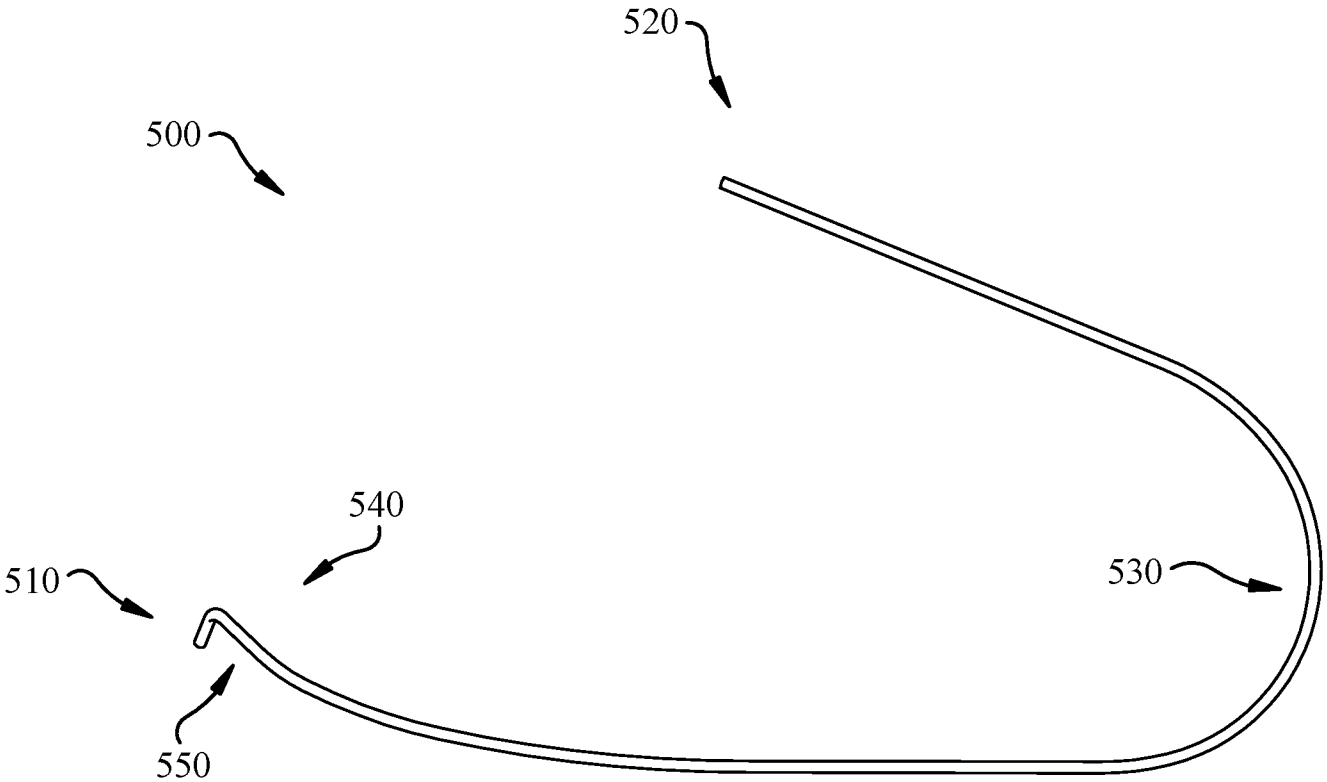
FIG. 5 shows a stiffness member in an earphone system arm such as the arm depicted in FIGS. 2-4.

FIG. 4 shows a partially transparent view of one implementation of the arm 240, illustrating components contained within the cover 330. FIG. 5 shows a stiffness member 500 which also extends through the arm 240, and is obstructed from view in FIG. 4. FIGS. 4 and 5 are referred to simultaneously. FIG. 4 illustrates an example implementation including a wiring wrap 400 within the cover 330 that surrounds the wiring 340 along the length of the cover 330. That is, the wiring wrap 400 is surrounded by the cover 330 and extends from the proximal end 350 to the distal end 380 of the arm 240. In some cases, the wiring wrap 400 is formed of paper, TPE, silicon, TPU, fiber stranding, or another flexible material (inherently or by geometrical design) with sufficient strength to hold the wires in place and position between the cover 330 and the wiring wrap 400. In the base section 300 and the middle section 310, the wiring wrap 400 can be surrounded by a jacket 410, however, in other implementations, the jacket 410 can be located alongside (e.g., axially coincident with) the wiring wrap 400 within the base section 300 and the middle section 310.

The jacket 410 surrounds the stiffness member 500 (FIG. 5), the length of which (between a proximal end 510 and a distal end 520) defines the base section 300. A portion 420 of the jacket 410 extends axially beyond the distal end 520 of the stiffness member 500, and this portion 420 of the jacket 410 defines the middle section 310. That is, with reference to FIGS. 3-5, the stiffness member 500 extends axially through the base section 300, and the jacket 410 extends axially through the base section 300 and the middle section 310. The portion 420 of the jacket 410 that extends distally beyond the stiffness member 500 can prevent the distal end 520 of the stiffness member 500 from piercing or otherwise interfering with the cover 330 or the wiring 340.

The stiffness member 500 can be formed of a material having a stiffness greater than approximately 10 newtons per meter (N/m) (and up to approximately 200 N/m), and in some cases can include a metal, an alloy, a plastic and/or a composite. In some cases, the stiffness member 500 includes a shape-memory material, such as a shape-memory polymer or shape-memory alloy. In particular examples, the stiffness member 500 includes a metal alloy such as nickel titanium (or, nitinol). In certain implementations, the stiffness member 500 can be pre-shaped into a deformed position, such that the stiffness member 500 positions the arm 240 in a particular resting angle. For example, the stiffness member 500 can be used to form an elbow 530 in the base section 300. In some cases, the elbow 530 is deformed at rest (e.g., on a surface such as a table) at an angle of approximately 15-45 degrees. It is understood that while resting on the head of the user, the elbow 530 can deform to a greater extent, e.g., up to 90 degrees, due to the weight of the earphone system 210.

In particular implementations, one or more portions of the arm 240 can include a shape-memory material that extends only partially along a length of the arm 240. For example, the stiffness member 500 can include a shape-memory material that can be temporarily deformed to take a pre-designed shape. The shape-memory material can include a conventional shape-memory alloy or polymer that retains a deformed shape, but can return to its original shape in response to an external stimulus (e.g., temperature change). In other cases, the shape-memory material can include a material that retains a deformed shape but does not return to its original shape in response to an external stimulus. In various implementations, the shape-memory material (e.g., stiffness member 500) can have an approximately constant thickness along its length (e.g., with only marginal deviation in thickness).

In some implementations, the tip section 320 can include a shape-memory material, e.g., in the wiring wrap 400 or as a distinct element, which allows a user to bend the tip section 320 over the top of the pinna to position the earphone 320 proximate the ear (and in some cases, in the ear). In these cases, the user can shape the tip section 320 for her particular head/ear shape and roughly retain that shaping between uses.

In other implementations, the arm 240 demonstrates substantially elastic deformation after removal from over the top of the pinna of the ear. That is, the arm 240, even if provided in a predefined shape, will revert to that predefined shape after removal of the earphone system 210 from the user's head (e.g., after resting on a surface).

In certain implementations, an outer dimension (e.g., diameter or width) of the arm 240 tapers from the base section 300 to the tip section 320, such that the tip section 320 has a smaller outer dimension than the base section 300. As noted herein, the narrower tip section 320 may demonstrate greater flexibility than the base section 300 and the middle section 310, for shaping the tip section 320 over the top of the pinna.

Additionally, with particular reference to FIG. 2, the stiffness of the tip section 320 configures that tip section 320 to flex over the top of the pinna of the user's ear to position the earphone 220 proximate the ear (in some cases, in the ear) while the earphone system 220 rests around the head of the user. In certain implementations, the base section 300 can include an arced region 540 for wrapping the arm 240 around the (back of the) head of the user while the tip section 320 wraps over the top of the pinna. This arced region 540 is also visible in FIGS. 3 and 4, and in the bend 550 at the proximal end 510 of the stiffness member 500. This arced region 540 can be contoured such that the electronics compartment 250 is located proximate the nape 295 of the user's head when both earphones 220 are located in the user's ears. In some cases, as shown in FIG. 5, the arced region 540 has a bend angle that is distinct from the bend angle of the elbow 530, and in particular cases, is approximately perpendicular to the bend angle of the elbow 530.

Figure 6:
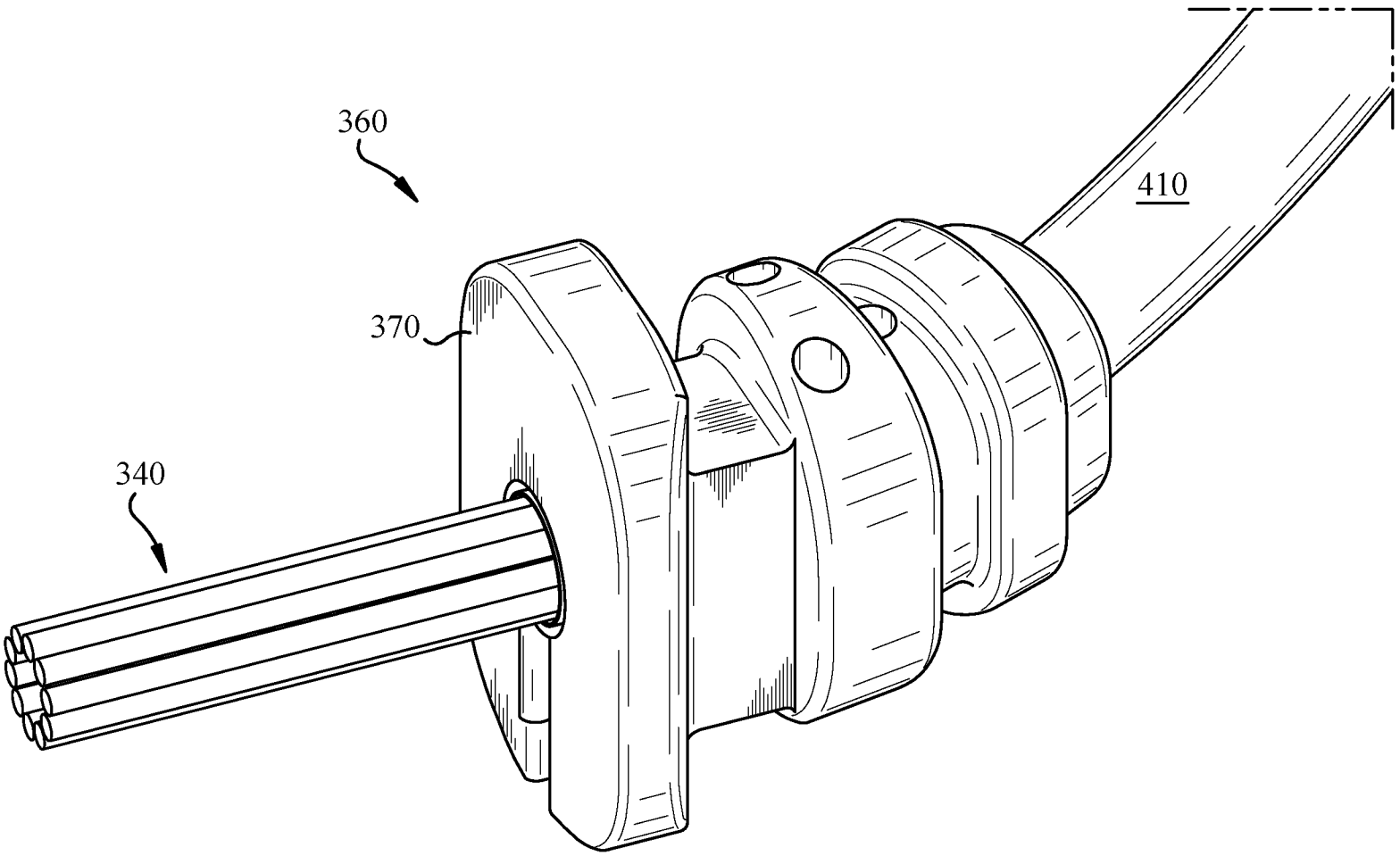
FIG. 6 is a close-up perspective view of a portion of an earphone system arm according to various implementations.
Figure 7:
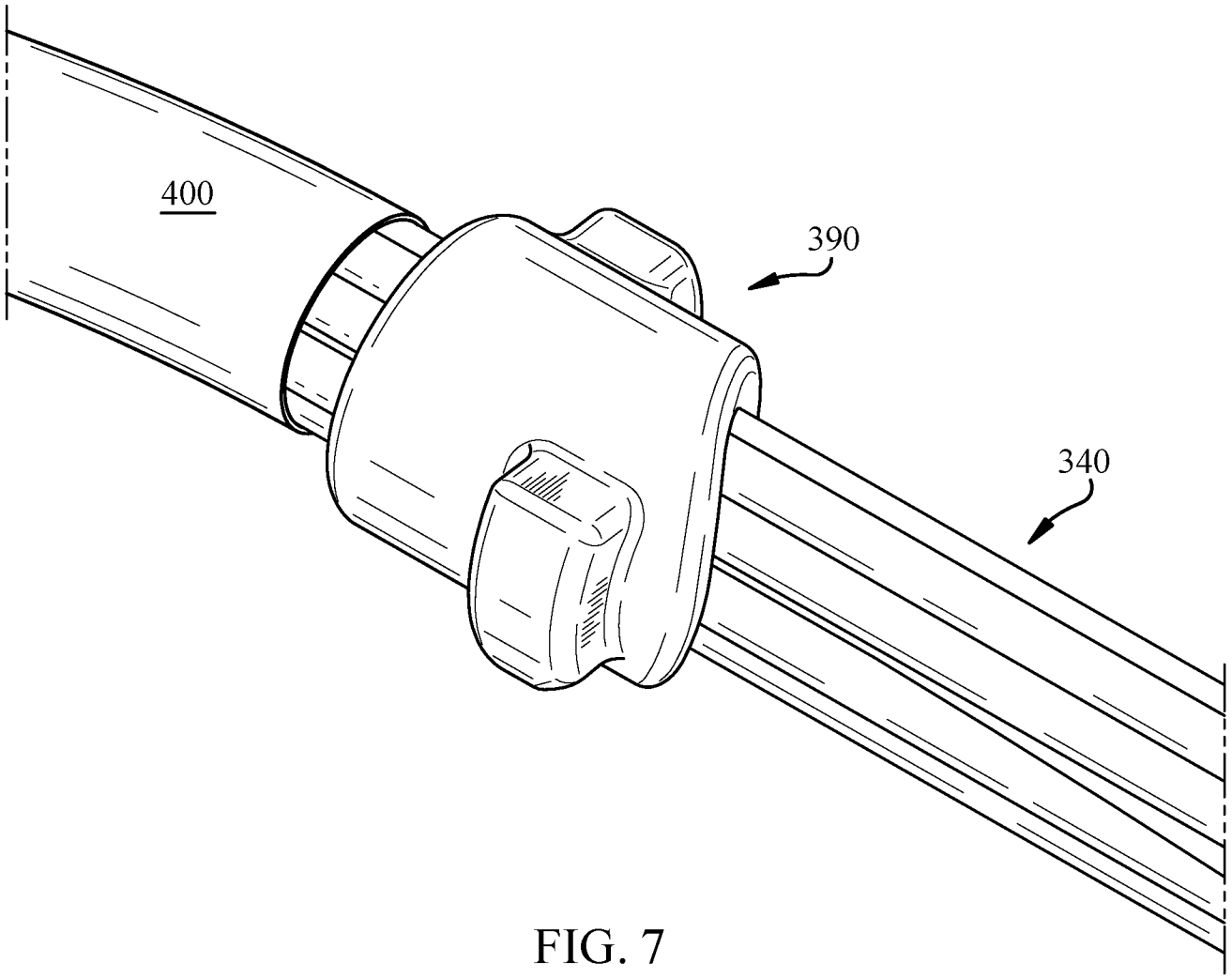
FIG. 7 is a close-up perspective view of a portion of an earphone system arm according to various implementations.

FIGS. 6 and 7 respectively show close-up partially transparent views of the rigid coupling 360 including stopper 370, and the earphone stopper 390. As is particularly visible in FIG. 6, the rigid coupling 360 includes an opening sized to receive the wiring 340. The earphone stopper 390 is sized to surround the wiring 340 on the opposite end of the arm 240. The rigid coupling 360 and/or earphone stopper 390 can include features such as ribs or protrusions for improving fit with neighboring materials (e.g., the material in the cover 330), and can aid in sealing (e.g., water resistant sealing) components in the arm 240 against external conditions.

Figure 8:
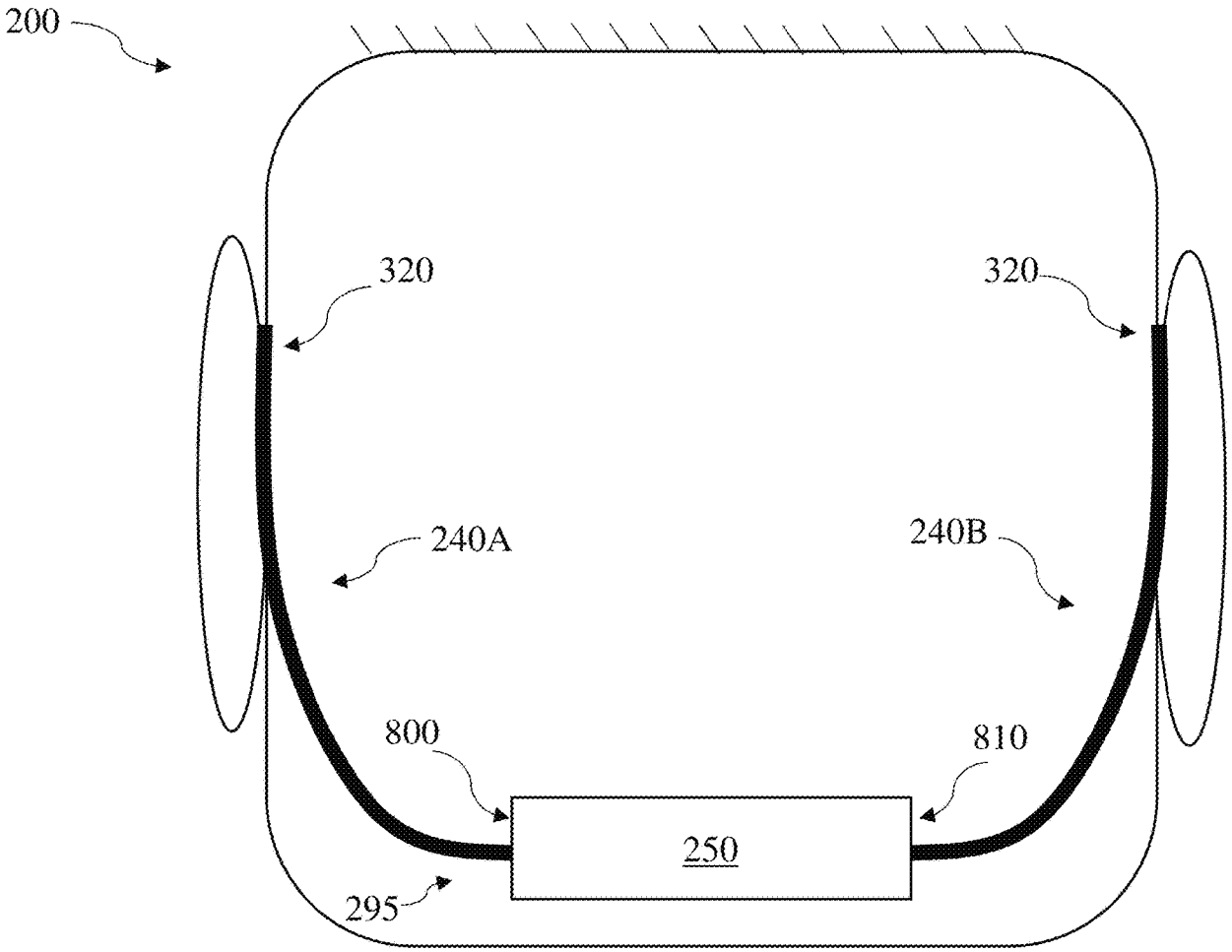
FIG. 8 is a schematic view of a back of a user's head while wearing an earphone system according to various implementations.

Returning to FIG. 2, with continuing reference to FIGS. 3-5, the tip section 320 is configured to support a portion of the weight of the earphone system 210 when the earphone system 210 rests around the head of the user 200. That is, the tip section 320 aids in retaining the earphone (or, earbud) 220 in the user's ear during use of the earphone system 210. This is further illustrated in the schematic depiction of the back of the user's head in FIG. 8. In this view, it is possible to see the arm 240 running over the top of the pinna of the ear (e.g., between the ear and the head), where the tip section 320 is supporting a portion of the weight of the earphone system 210 while the system rests around the user's head. In some cases, as described herein, a pair of arms 240 are used to couple distinct ends of the electronics compartment 250 with the distinct earphones (obstructed in FIG. 8). That is, a first arm 240A is coupled with a first side 800 of the electronics compartment 250 and an additional arm 240B is coupled with a second side 810 of the electronics compartment 250 (as well as the other earphone 220, not shown). In this case, the arms 240A,B position the electronics compartment 250 to rest proximate the nape 295 of the user's head while the earphones 220 (FIG. 2) rest proximate the user's ear, for example, within the user's ear. In various implementations, as noted herein, the arms 240A,B can provide a clamping force on the user's head such that the electronics compartment 250 rests proximate the nape 295 of the user's head while the head rotates and/or moves up or down. This clamping force can help to comfortably secure the earphone system 210 on the user's head during use, while maintaining the desired seal on the ear canal to prevent unwanted feedback.

Figure 9:
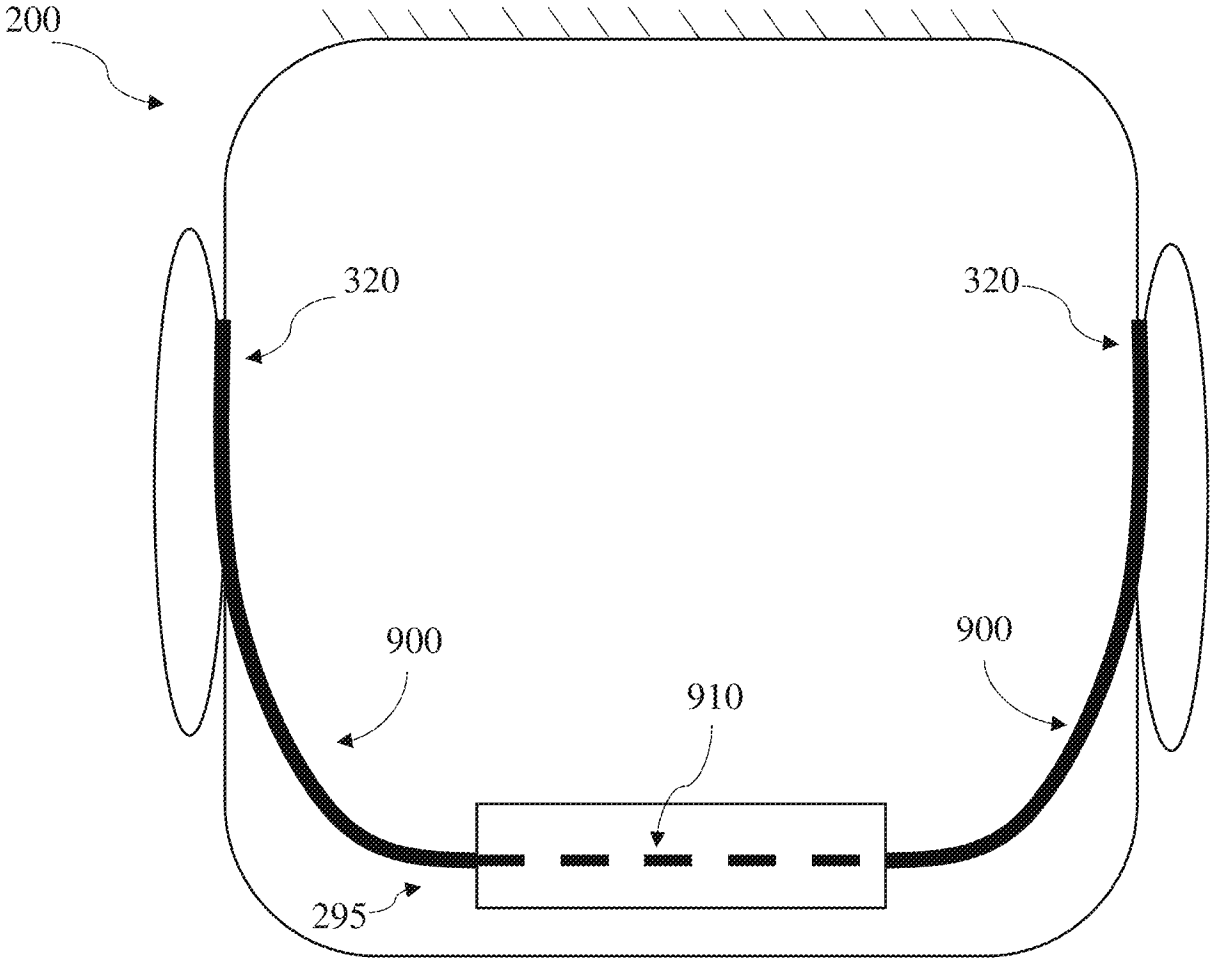
FIG. 9 is a schematic view of a back of a user's head while wearing an earphone system according to various additional implementations.

In some additional implementations, as illustrated in FIG. 9, a single arm 900 can couple both of the earphones 220 (FIG. 2) with the electronics compartment 250. In these implementations, a section 910 of the single arm 900 passes through the electronics compartment 250 to connect the pair of earphones 220 (FIG. 2). In some cases, this section 910 can fit within a groove or slot in the electronics compartment 250, or can be coupled (e.g., adhered or bound) to an outer surface of the electronics compartment 250. In some particular implementations, the single arm 900 can include one or more stoppers or limiters to prevent the electronics compartment 250 from undesirable sliding relative to the single arm 900. The single arm 900 can include two distinct tip sections, such as tip sections 320. In some cases, the single arm 900 can additionally include two distinct base sections (similar to base section 300), as well as two distinct middle sections (similar to middle section 310), where the single arm 900 is substantially symmetrical about the electronics compartment 250. In this case, two stiffness members (e.g., similar to stiffness member 250) can be positioned each within the respective base sections that extend from the first side 800 of the electronics compartment 250 and the second side 810 of the electronics compartment 250, respectively.

However, in other implementations, an earphone system can include a single stiffness member that passes through the electronics compartment 250 and extends to connect with a pair of earphones 220. In still other cases, a single arm (e.g., including a single stiffness member or two separate stiffness members) can be employed, including a slot or cavity for housing the electronics in the electronics compartment 250. In these cases, connections between the electronics and the earphones 220 can be made within the arm, i.e., internal to the cover 330.

In any case, the arm 900 positions the electronics compartment 250 to rest proximate the nape 295 of the user's head while the earphones 220 (FIG. 2) rest proximate the user's ear, e.g., within the user's ear. In various implementations, the arm 900 can provide a clamping force on the user's head such that the electronics compartment 250 rests proximate the nape 295 of the user's head while the head rotates and/or moves up or down. This clamping force can help to comfortably secure the earphone system 210 on the user's head during use, while maintaining the desired seal on the ear canal to prevent unwanted feedback.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other embodiments are within the scope of the following claims.

We claim:

1. An arm for an earphone system, the arm comprising:

a base section for coupling with an electronics compartment, the base section having a first stiffness;

a middle section continuous with the base section and having a second stiffness that is less than the first stiffness; and a tip section continuous with the middle section for coupling with an earphone, the tip section having a third stiffness that is less than the second stiffness, wherein the tip section is configured to flex over the top of the pinna of an ear of a user to position the earphone proximate the ear of the user while the earphone system rests around a head of the user, and wherein the tip section is configured to support a portion of a weight of the earphone system when the earphone system rests around the head of the user.

2. The arm of claim 1, wherein the base section comprises an arced region for wrapping the arm around the head of the user while the tip section wraps over the top of the pinna of the ear.

3. The arm of claim 1, wherein the arm demonstrates substantially elastic deformation after removal from over the top of the pinna of the ear of the user.

4. The arm of claim 1, further comprising a shape-memory material configured to retain a portion of a shape formed by positioning the tip section over the top of the pinna of the ear of the user.

5. The arm of claim 4, wherein the shape-memory material extends only partially along a length of the arm, wherein the shape-memory material has an approximately constant thickness along its length.

6. The arm of claim 1, wherein the earphone comprises an earbud sized to rest within the ear of the user, and wherein the tip section aids in retaining the earbud within the ear of the user during use of the earphone system.

7. The arm of claim 1, further comprising:

wiring for transmitting communication signals between the electronics compartment and the earphone;

a stiffness member;

a jacket surrounding the stiffness member and the wiring; and a cover surrounding the jacket, the stiffness member and the wiring.

8. The arm of claim 7, wherein the cover and the wiring each extend axially through the base section, the middle section and the tip section, the stiffness member extends axially through the base section, and the jacket extends axially through the base section and the middle section.

9. The arm of claim 1, further comprising a rigid coupling at an end of the base section for connecting the arm with the electronics compartment.

10. The arm of claim 1, wherein an outer dimension of the arm tapers from the base section to the tip section.

11. The arm of claim 1, wherein the base section comprises an elbow that is deformed at rest at an angle of approximately 15-45 degrees.

12. The arm of claim 1, wherein as measured along a primary axis of the arm, a length of the middle section is less than a length of each of the base section and the tip section.

13. An earphone system comprising:

a pair of earphones for positioning in respective ears of a user;

an electronics compartment; and an arm connected with at least one of the earphones and the electronics compartment, the arm comprising:

a base section coupled with the electronics compartment, the base section having a first stiffness;

a middle section continuous with the base section and having a second stiffness that is less than the first stiffness; and a tip section continuous with the middle section and coupled with at least one of the earphones, the tip section having a third stiffness that is less than the second stiffness, wherein the tip section is configured to flex over the top of the pinna of one of the ears of the user to position the at least one earphone proximate the ear of the user when the earphone system rests around a head of the user, and wherein the tip section is configured to support a portion of a weight of the earphone system when the earphone system rests around the head of the user.

14. The earphone system of claim 13, wherein the base section comprises an arced region for wrapping the arm around the head of the user while the tip section wraps over the top of the pinna of the ear.

15. The earphone system of claim 13, wherein the arm demonstrates substantially elastic deformation after removal from over the top of the pinna of the ear of the user, or the arm comprises a shape-memory material configured to retain a portion of a shape formed by positioning the tip section over the top of the pinna of the ear of the user.

16. The earphone system of claim 13, wherein the earphone comprises an earbud sized to rest within the ear of the user, wherein the tip section of the arm aids in retaining the earbud within the ear of the user during use of the earphone system, and wherein the arm positions the electronics compartment to rest proximate a nape of the head of the user while the earbud is located within the ear of the user.

17. The earphone system of claim 13, wherein the arm further comprises:

wiring for transmitting communication signals between the electronics compartment and the at least one earphone;

a stiffness member;

a jacket surrounding the stiffness member and the wiring; and a cover surrounding the jacket, the stiffness member and the wiring, wherein the cover and the wiring each extend axially through the base section, the middle section and the tip section, the stiffness member extends axially through the base section, and the jacket extends axially through the base section and the middle section.

18. The earphone system of claim 13, wherein an outer dimension of the arm tapers from the base section to the tip section, and wherein the base section of the arm comprises an elbow that is deformed at rest at an angle of approximately 15-45 degrees.

19. The earphone system of claim 13, wherein the arm is coupled to both of the earphones and the electronics compartment.

20. The earphone system of claim 13, wherein the arm comprises a single band passing through the electronics compartment to connect the pair of earphones.

21. The earphone system of claim 13, wherein the arm is coupled with a first side of the electronics compartment and an additional arm is coupled with a second side of the electronics compartment and the other one of the pair of earphones, wherein the arm and the additional arm position the electronics compartment to rest proximate a nape of the head of the user while the pair of earphones rest proximate the ears of the user wherein the arm and the additional arm provide a clamping force on the head of the user such that the electronics compartment rests proximate the nape of the head of the user while the head rotates.

22. The earphone system of claim 13, wherein as measured along a primary axis of the arm, a length of the middle section is less than a length of each of the base section and the tip section.

23. An earphone system comprising:

a pair of earphones for positioning in respective ears of a user;

an electronics compartment; and an arm connected with at least one of the earphones and the electronics compartment, the arm comprising:

a base section coupled with the electronics compartment, the base section having a first stiffness;

a middle section continuous with the base section and having a second stiffness that is less than the first stiffness;

a tip section continuous with the middle section and coupled with at least one of the earphones, the tip section having a third stiffness that is less than the second stiffness, wherein the tip section is configured to flex over the top of the pinna of one of the ears of the user to position the at least one earphone proximate the ear of the user when the earphone system rests around a head of the user;

wiring for transmitting communication signals between the electronics compartment and the at least one earphone;

a stiffness member;

a jacket surrounding the stiffness member and the wiring; and a cover surrounding the jacket, the stiffness member and the wiring, wherein the cover and the wiring each extend axially through the base section, the middle section and the tip section, the stiffness member extends axially through the base section, and the jacket extends axially through the base section and the middle section.

24. The earphone system of claim 23, wherein the arm is coupled with a first side of the electronics compartment and an additional arm is coupled with a second side of the electronics compartment and the other one of the pair of earphones, wherein the arm and the additional arm position the electronics compartment to rest proximate a nape of the head of the user while the pair of earphones rest proximate the ears of the user.

* * * * *